United States Patent [19]

Bloem

[11] 4,057,901

[45] Nov. 15, 1977

[54] WET COMB

[76] Inventor: Gary Bloem, 175-19th Ave., San Francisco, Calif. 94121

[21] Appl. No.: 601,612

[22] Filed: Aug. 4, 1975

[51] Int. Cl.[2] ..... A45D 24/22

[52] U.S. Cl. ..... 132/112

[58] Field of Search ..... 132/112, 113, 11 R, 132/9; 206/419, 42 C, 581, 573, 235, 823; 220/DIG. 26

[56] References Cited

U.S. PATENT DOCUMENTS

| | | | |
|---|---|---|---|
| 1,228,091 | 5/1917 | Bradley | 273/131 AB |
| 1,384,671 | 7/1921 | Murray | 132/113 |
| 1,455,193 | 5/1923 | Duquette | 273/131 AB |
| 2,381,048 | 8/1945 | Habostad | 132/113 |
| 2,772,885 | 12/1956 | Wales | 273/131 AB |
| 2,794,443 | 6/1957 | Moore | 132/113 |

*Primary Examiner*—G.E. McNeill

[57] ABSTRACT

A comb is disclosed for applying a metered amount of a liquid preparation to the hair. The back of the comb has a reservoir and a metering chamber operably connected to the reservoir through a valve. The metering chamber is mounted over the teeth of the comb and has openings to allow its liquid contents to flow by means of gravity out of the chamber and in the direction of the teeth of the comb.

1 Claim, 4 Drawing Figures

WET COMB

SUMMARY OF THE INVENTION

The present invention relates to a wet comb comprising a flat elongated comb back having a plurality of comb teeth extending laterally from the back, the back containing a liquid reservoir and a metering chamber mounted below the reservoir. A valve is positioned between the reservoir and the metering chamber to operably connect the two and is employed to feed liquid to said chamber by gravity when the teeth of the comb are pointed downwards. Effluent ports are provided in the comb back for passing liquid from the chamber laterally in the direction of the comb teeth when the teeth are pointed downwards.

DETAILED DESCRIPTION

Wet combs known in the prior art suffer the disadvantage that liquids dispensed by such combs cannot be measured. The liquid reservoirs of the prior art combs in some instances contain valves for turning the dispensing apparatus on or off, but are not able to give an indication of the amount of liquid that is being applied nor can such combs be readily controlled to supply a definite amount of a hair preparation during use.

It is therefor an object of the present invention to overcome these and other difficulties encountered in the prior art.

It is another object of the present invention to provide a novel wet comb having a chamber for metering a definite amount of liquid and dispensing the same.

It is a further object of the present invention to provide novel reservoir and metering chamber sections in a wet comb.

It is a further object of the present invention to provide a novel valve and valve arrangement for transferring liquid from a reservoir to a metering chamber in a wet comb.

These and other objects have been achieved according to the present invention and will become apparent by reference to the disclosure and claims that follow as well as the appended drawing.

Figure 1:
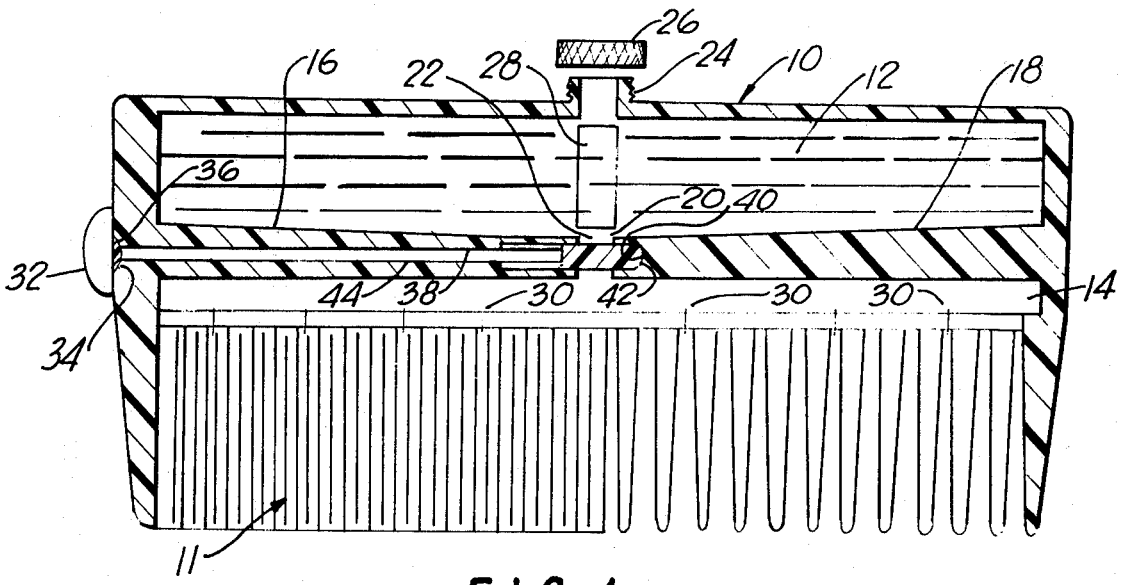
FIG. 1 is a side elevation in section of one embodiment of the wet comb of the present invention.
Figure 2:
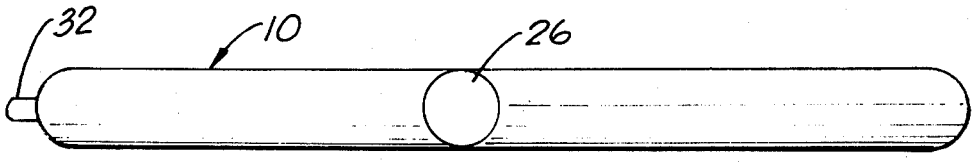
FIG. 2 is a plan view of the wet comb illustrated in FIG. 1.
Figure 3:
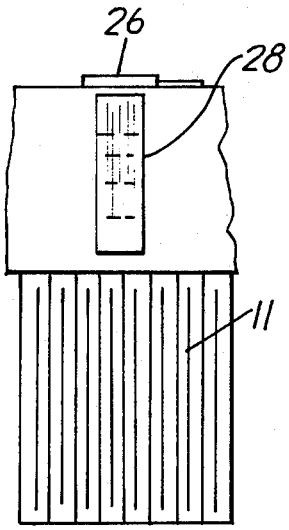
FIG. 3 is a fragmentary side elevation illustrating the sight glass employed to indicate the contents of the wet comb according to one embodiment of the present invention.
Figure 4:
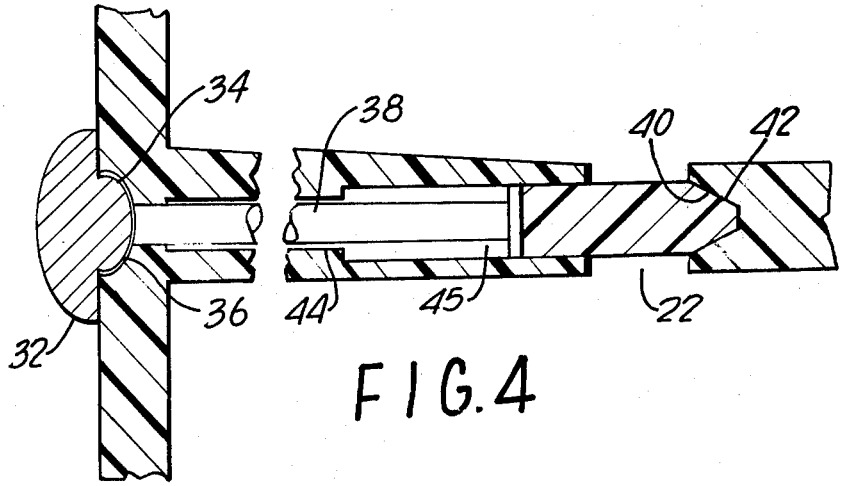
FIG. 4 is a fragmentary side elevation partially in section illustrating a valve employed to transfer liquids from a reservoir in a wet comb to a metering chamber mounted beneath the comb according to one embodiment of the present invention.

Referring to FIGS. 1–4 a wet comb is shown having a flat elongated comb back 10 with comb teeth 11 extending laterally from the comb back. The back has a liquid reservoir 12 also extending flatly and along the length of the comb back 10, the bottom 16 and 18 of said reservoir 12 tapering to an apex 20 wherein an opening 22 is positioned. A calibrated sight glass 28 is mounted on the side of reservoir 12 so the contents of reservoir 12 can be determined by visual inspection. A screw cap

26 is provided to screwingly engage threaded aperture 24 mounted on top of comb back 10 to permit introduction of liquids into reservoir 12. A metering chamber 14 is mounted in comb back 10 beneath reservoir 12 and communicates therewith through opening 22, metering chamber 14 also extending in the same direction as comb back 10 and reservoir 12. Openings 30 are provided at the bottom of chamber 14 for allowing the contents thereof to empty by gravity laterally in the direction of teeth 11 when the chamber 14 is filled with a liquid and the teeth pointed downward. Reservoir 12 also feeds chamber 14 through opening 22. A resillient valve face 40, such as a rubber valve face, can be unseated and moved backward into chamber 45 so that liquid will flow by gravity into chamber 14 from reservoir 12. Valve face 40 is tapered and in the configuration illustrated in the drawing is a frusto-conical configuration that engages a correspondingly shaped valve seat 42. Valve face 40 extends backward into a valve body which is also made of a resilient material such as rubber. A valve stem 38 is operably connected to the valve body and is slidably movable in valve guide 44, so that it may draw the valve body into opening 45 to allow liquid to flow from reservoir 12 into chamber 14. Stem 38 terminates in a knob that is gripable between the thumb and forefinger and has extending therefrom a plunger 34 facing in the direction of the comb back. The plunger 34 is attached to knob 32 at a point on plunger 34 less than the diameter of plunger 34, a corresponding opening 36 being provided in back 10 to receive and partially envelop plunger 34 so that it is releasably securable to the comb back 10. Plunger 34 is made of a yieldable material such as a thermoplastic material or rubber or any of the art known equivalents thereof.

In use, a liquid such as water, hair dye, hair tint, hair waving lotion, hair bleach and the like is introduced into reservoir 12 through removable cap 28 and the comb is held in a position such that the teeth thereof are pointing downward. Knob 32 is pulled away from the comb and liquid flows by gravity from reservoir 12 into metering chamber 14 through opening 22, since valve seat 42 does not have valve face 40 sealingly engaging it. The valve body is drawn into chamber 45 thereby permitting the flow of liquid downwards through opening 22. Liquid than passes out of the openings 30 in the direction of the comb teeth 11 so that it may be applied to hair. The tapered configuration of the bottom of reservoir 12 assures that substantially all liquid contained therein will flow to the opening 22 for transfer to chamber 14. Graduated sight glass 28 is employed to visually determine the amount of liquid in reservoir 12, so that it can be refilled when necessary. The metered amount of liquid in chamber 14 allows the application of controlled amounts of liquid to hair which is especially critical in the application of hair tints, dyes or bleaches.

Although the invention has been described by reference to some embodiments, it is not intended that the novel apparatus be limited thereby, but that certain modifications thereof are intended to be included within the broad scope and spirit of the foregoing disclosure, the following claims and the appended drawing.

What is claimed is:

1. A wet comb comprising a flat elongated comb back means, said back means having a plurality of comb teeth means extending laterally from said back means, said back means containing liquid reservoir means which comprise an elongated flat reservoir extending in the same direction as said back means and mounted within said back means, said reservoir laterally tapering from both ends to valve means to form a gravity flow path for feeding liquid to said valve at the apex of said taper, said reservoir means having capped filler means extending upwardly through said back means for filling said reservoir means with liquid and capping said reservoir means after filling, sight glass means mounted on the side of said reservoir means and extending through said back for visually determining the amount of liquid in said reservoir means, metering chamber means mounted below said reservoir means, said chamber means also being mounted in said back and comprising an elongated flat chamber extending in the same direction as said back means and mounted under said reservoir means, said valve means operably connecting said reservoir means to said chamber means for feeding liquid to said chamber means by gravity when said teeth are pointed downwards, said valve means comprising a resilient tapered valve face for sealingly engaging a corresponding tapered valve seat mounted in said back means, valve control means extending from said valve means through said back means and terminating in finger gripable knob means, said knob means having means extending therefrom for releasably securing said knob to said back, said valve control means comprising a stem extending along the length of said back means from said valve face to one end of said back means through valve stem guide means in said back means, said stem operably engaging said face means, said means for securing said knob to said back comprising a plunger secured to said knob at one end opposite the diameter of said plunger, a notch releasably receiving said plunger and comprising an opening in said back oppositely facing said plunger and of a configuration to partially envelop and releasably secure said plunger, effluent means in said chamber means for passing liquid from said chamber means laterally in the direction of said teeth when said teeth are pointed downward.

* * * * *